US007086110B2

(12) United States Patent
Aouad

(10) Patent No.: US 7,086,110 B2
(45) Date of Patent: Aug. 8, 2006

(54) SELECTIVE DISPENSING OF LAUNDRY ADDITIVES DURING AUTOMATIC MACHINE LAUNDERING OF FABRIC

(75) Inventor: Yousef Georges Aouad, Cincinnati, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 168 days.

(21) Appl. No.: 10/777,512

(22) Filed: Feb. 12, 2004

(65) Prior Publication Data

US 2004/0216500 A1 Nov. 4, 2004

Related U.S. Application Data

(63) Continuation-in-part of application No. 10/366,204, filed on Feb. 13, 2003, now Pat. No. 7,036,177, and a continuation-in-part of application No. 10/366,100, filed on Feb. 13, 2003, now Pat. No. 7,036,176, and a continuation-in-part of application No. 10/289,936, filed on Nov. 7, 2002, and a continuation-in-part of application No. 10/737,429, filed on Dec. 16, 2003.

(60) Provisional application No. 60/526,642, filed on Dec. 3, 2003, provisional application No. 60/435,646, filed on Dec. 20, 2002, provisional application No. 60/356,544, filed on Feb. 13, 2002, provisional application No. 60/356,543, filed on Feb. 13, 2002.

(51) Int. Cl.
*D06D 39/08* (2006.01)

(52) U.S. Cl. ..... 8/159; 68/17 R; 68/207

(58) Field of Classification Search ..... 68/17 A, 68/17 R, 207; 222/92, 80, 94; 8/158, 159
See application file for complete search history.

(56) References Cited

U.S. PATENT DOCUMENTS 2,956,709 A * 10/1960 Morris et al. ..... 222/129

(Continued)

FOREIGN PATENT DOCUMENTS

CA 1 133 712 10/1982

(Continued)

OTHER PUBLICATIONS

WIPO WO 01/07703 Feb. 2001.*

*Primary Examiner*—Frankie L. Stinson
(74) *Attorney, Agent, or Firm*—Julia A. Glazer; Steven W. Miller

(57) ABSTRACT

Disclosed are systems, methods, devices and kits for the timed dispensing of laundry additive materials into the drum during a cycle of a multiple cycle fabric laundering operation. To bring about such dispensing of additives, a housing structure device having multiple chambers is placed within the drum of an automatic washing machine, a unit dose insert package, containing laundry additives in at least one compartment of the insert, is placed within the housing structure, and the machine is run through the several stages of its laundering cycle. A piercing element is provided to open the compartment of the insert in the laundering cycle to dispense contents of this compartment into the washing machine drum as rinse additive materials. The contents move from the insert to the first chamber of the housing structure device by centrifugal force arising during the first spin cycle of the laundering operation. The centrifugal force also holds the contents within the first chamber until cessation of the spin cycle. The contents move from the second chamber to the third chamber to be dispensed from the housing structure into the washing machine drum upon cessation of the spin cycle and during the second spin cycle.

19 Claims, 5 Drawing Sheets

U.S. PATENT DOCUMENTS

| | | | | | |
|---|---|---|---|---|---|
| 2,979,231 | A | * | 4/1961 | Witherspoon, Jr. | 222/83.5 |
| 3,048,993 | A | * | 8/1962 | Lucas | 68/17 A |
| 3,053,066 | A | * | 9/1962 | Dodd | 68/23.4 |
| 3,095,722 | A | * | 7/1963 | Fox | 68/207 |
| 3,166,096 | A | * | 1/1965 | Helmut | 137/564.5 |
| 3,268,120 | A | * | 8/1966 | Durst | 222/168 |
| 3,988,908 | A | | 11/1976 | Beare et al. | |
| 4,026,131 | A | * | 5/1977 | Dugger et al. | 68/17 A |
| 4,154,069 | A | * | 5/1979 | Lipfert et al. | 68/17 A |
| 4,186,573 | A | | 2/1980 | Brenner et al. | |
| 4,188,807 | A | * | 2/1980 | Graf et al. | 68/17 R |
| 4,260,054 | A | | 4/1981 | Bory et al. | |
| 4,265,372 | A | | 5/1981 | Wainberg | |
| 4,379,515 | A | | 4/1983 | Towsend | |
| 4,416,791 | A | | 11/1983 | Haq | |
| 4,429,812 | A | | 2/1984 | Steiner et al. | |
| 4,588,080 | A | | 5/1986 | Ginn | |
| 4,700,857 | A | | 10/1987 | Kittscher et al. | |
| 4,835,804 | A | * | 6/1989 | Arnau-Munoz et al. | 8/158 |
| 4,882,917 | A | | 11/1989 | Mizusawa et al. | |
| 4,915,267 | A | * | 4/1990 | Buecheler et al. | 222/463 |
| 4,982,467 | A | | 1/1991 | Mizusawa et al. | |
| 5,033,643 | A | | 7/1991 | Schumacher | |
| 5,061,807 | A | | 10/1991 | Gethöffer et al. | |
| 5,129,120 | A | | 7/1992 | Cornette et al. | |
| 5,133,487 | A | | 7/1992 | Russi | |
| 5,176,297 | A | | 1/1993 | Mooney et al. | |
| 5,314,098 | A | * | 5/1994 | Milenkevich | 222/463 |
| 5,536,421 | A | | 7/1996 | Hartman et al. | |
| 5,687,588 | A | | 11/1997 | Azzani et al. | |
| 5,732,853 | A | | 3/1998 | Ganzeboom et al. | |
| 5,792,219 | A | | 8/1998 | Hartman et al. | |
| 6,138,693 | A | * | 10/2000 | Matz | |
| 6,179,167 | B1 | | 1/2001 | Boot et al. | |
| 6,203,535 | B1 | | 3/2001 | Barney et al. | |
| 6,281,183 | B1 | | 8/2001 | Harbour | |
| 6,352,158 | B1 | | 3/2002 | Cole-Bennett et al. | |
| 6,375,041 | B1 | * | 4/2002 | Klima et al. | |
| 6,378,274 | B1 | | 4/2002 | Harbour | |
| 6,439,387 | B1 | | 8/2002 | Bergman | |
| 6,681,963 | B1 | * | 1/2004 | Hague et al. | |
| 2001/0049846 | A1 | | 12/2001 | Guzzi et al. | |
| 2002/0078589 | A1 | | 6/2002 | Hagemann et al. | |
| 2002/0088502 | A1 | | 7/2002 | Van Rompuy et al. | |
| 2002/0100773 | A1 | | 8/2002 | Rodd et al. | |
| 2002/0108969 | A1 | | 8/2002 | Rodd et al. | |
| 2003/0172960 | A1 | | 9/2003 | Aouad et al. | |
| 2003/0172961 | A1 | | 9/2003 | Aouad et al. | |
| 2003/0182732 | A1 | | 10/2003 | Davenet et al. | |
| 2004/0088796 | A1 | | 5/2004 | Neergaard et al. | |

FOREIGN PATENT DOCUMENTS

| | | | |
|---|---|---|---|
| DE | 39 22 342 | | 1/1991 |
| DE | 39 34 123 | | 4/1991 |
| DE | 101 14 256 | A1 | 3/2001 |
| DE | 199 45 849 | | 3/2001 |
| EP | 0 351 671 | | 7/1989 |
| EP | 1 195 350 | | 4/2002 |
| WO | WO 94/07979 | | 4/1994 |
| WO | WO 96/26312 | | 8/1996 |
| WO | WO 97/09480 | | 3/1997 |
| WO | WO 00/02982 | | 1/2000 |
| WO | WO 00/02987 | | 1/2000 |
| WO | WO 00/29537 | | 5/2000 |
| WO | WO 00/49218 | | 8/2000 |
| WO | WO 01/07702 | | 2/2001 |
| WO | WO 01/07703 | | 2/2001 |
| WO | WO 01/07704 | | 2/2001 |
| WO | WO 01/16271 | | 3/2001 |
| WO | WO 01/23295 | | 4/2001 |
| WO | WO 01/25526 | | 4/2001 |
| WO | WO 01/25527 | | 4/2001 |
| WO | WO 03/069042 | | 8/2003 |
| WO | WO 03/069043 | | 8/2003 |
| WO | WO 2004/044303 | A1 | 5/2004 |
| ZA | 9800086 | * | 1/1998 |

* cited by examiner

SELECTIVE DISPENSING OF LAUNDRY ADDITIVES DURING AUTOMATIC MACHINE LAUNDERING OF FABRIC

CROSS REFERENCE TO RELATED APPLICATIONS

This application claims the benefit of: provisional application U.S. Ser. No. 60/526,642 filed Dec. 3, 2003 and is a continuation-in-part of: U.S. Ser. No. 10/366,204, filed Feb. 13, 2003 now U.S. Pat. No. 7,036,177 which claims the benefit of provisional application U.S. Ser. No. 60/356,544, filed Feb. 13, 2002; U.S. Ser. No. 10/366,100, filed Feb. 13, 2003 now U.S. Pat. No. 7,036,176 which claims the benefit of provisional application U.S. Ser. No. 60/356,543, filed Feb. 13, 2002; U.S. Ser. No. 10/289,936, filed Nov. 7, 2002 still pending; and U.S. Ser. No. 10/737,429, filed Dec. 16, 2003 still pending which claims the benefit of provisional application U.S. Ser. No. 60/435,646, filed Dec. 20, 2002.

TECHNICAL FIELD

The present invention relates to systems, methods, devices and kits for adding separate rinse additive materials to the drum (tub) of an automatic fabric laundering (washing) machine during one cycle of a multiple cycle operation. The separate laundry additive materials themselves are packaged in a unit dose form which is inserted into a holder device (housing structure) within the washing machine drum in order to effect dispensing of the laundry additive materials into the washing machine drum at the appropriate time.

BACKGROUND OF THE INVENTION

There are a great many types of laundry additive materials suitable for use in automatic washing machines for fabric laundering. Cleaning agents such as surfactants and detergent builders are used to assist in the mechanical removal of soil and stains from fabrics being laundered. Bleaching agents, enzymes and adjuvants relating thereto are designed to promote chemical degradation and removal of soils and stains. Fabric conditioners, softeners, anti-wrinkle agents, soil release materials and similar agents serve to alter and enhance the condition, appearance or feel of laundered fabrics. Other auxiliary materials, such as pH adjustment and control agents, buffers, solvents, dispersants, anti-redeposition agents, dye transfer inhibitors, stabilizers, preservatives, perfumes, dyes and the like are used to alter the aqueous environment in the automatic washing machine drum to provide for optimum performance of the active laundry additive materials or to improve the quality or aesthetics of commercialized laundry products containing these active additive materials.

The several types of laundry additive materials described hereinbefore, frequently intermingled or admixed together in a wide variety of combinations for convenience, are commonly marketed to consumers in bulk quantities, in either solid, i.e., granular or tablet, or liquid form. To carry out the laundering operation, the consumer then adds aliquots of product as needed or desired from the bulk products into the automatic washing machine drum in appropriate amounts and at appropriate times during the laundering cycle.

It would be desirable, and a number of attempts have been made, to market fabric laundering products in "unit dose" form whereby aliquots of laundry additive materials are provided in pre-measured, pre-packaged form. The consumer can then conveniently add one of these unit dose aliquots to the automatic washing machine, e.g., into the drum, at the beginning of the laundry cycle and not have to measure product from bulk or add product to the cycle at different subsequent points in time.

Several factors complicate the provision of certain types of laundry additive materials in unit dose form. In the first place, some types and forms of laundry additives are not compatible with each other within a single concentrated product. Different types of materials may chemically interact with each other when admixed in concentrated form, thereby degrading and rendering one or both types ultimately ineffective for its intended purpose. Such incompatibility works against combining such materials together within a single unit dose product.

The major complicating factor in providing unit dose laundry products is that different types of laundry additives work best under different sets of conditions. Such different conditions are those which occur as the laundering operation progresses through its cycles which generally include one or more washing and rinsing stages within the drum. The need therefore arises to add different types of laundry additives to the washing machine drum at different times during the laundering procedure. For example, a number of types of fabric conditioners and softeners and other additives are best added to the rinse stages of the laundering operation. In some cases materials may not work in the way they are intended if they are present in the relatively high pH washing stages in the presence of chemically incompatible surfactants, builders, enzymes and other types of materials which perform their functions in the washing cycle(s). Thus even when provided in unit dose form, a number of materials which are typically thought of as rinse additives must be placed in the washing machine during the rinse cycle, well after the initial stages of the laundering operation have begun. This can create the need for the consumer to return to the washing machine at the beginning of the rinse cycle to add the materials which are to function during the rinsing operation. In other cases, it may be desirable to design laundry cycles with multiple wash and/or rinse cycles and it may be desired to place a washing additive such as a detergent in a unit dose forum to be released in one or more wash cycles.

A number of attempts have been made to permit the consumer to place laundry additive materials into devices or dispensers at the beginning of the laundering operation with those devices or dispensers serving to add the additives to the laundry cycle automatically. Addition can thus occur without further consumer involvement when the appropriate cycle is reached later in the laundering operation. Many of such devices and dispensers operate by having their dispensing action activated by the centrifugal force. Centrifugal force, of course, arises as a consequence of the spin cycle in the machine laundering process. A fast spin cycle generally follows the washing step and serves to drain the washing machine drum of wash water prior to the addition of rinse water for the rinse cycle which follows the spin cycle.

Use of centrifugal force activated devices, dispensers or packages for delivery of laundry additives to the laundry cycles in an automatic laundering machine operation is not without its difficulties. In the first place, it is not simple or straightforward to fashion such devices, dispensers or packages in a way such that they are useful with or as unit dose packages of additives. In the second place, systems utilizing unit dose packages of laundry additives must be designed so that the unit dose can survive the stresses and rigors of one or more stages of the laundering operation while remaining unopened and intact. Finally, the centrifugal force-activated dispensing means for the unit dose must be configured so that the unit dose of laundry additives is not added to the washing machine drum too soon after the spin cycle begins. If the additive contents of the unit dose are released into the drum too early, much of these contents are lost with the water being drained from the drum during the spin cycle.

Given the foregoing difficulties in formulating unit dose products, it is desirable to provide a system which can effectively utilize additive products in unit dose form to deliver laundry adjuvants to the drum of an automatic fabric laundering machine during the machine's various operational cycle. This is realized by providing a unit dose in the form of a certain type of rigid or flexible package. Such a package is then placed as an insert into a certain type of housing device which is positioned within the washing machine drum and which serves to bring about the desired manner and timing of dispensing of additives into the washing machine drum.

BACKGROUND ART

Devices which can dispense laundry additive materials into one or more stages of a machine laundering operation are disclosed in U.S. Pat. No. 4,186,573 and PCT Publication WO 01/25526. Products in the form of a pouch or container which can be used for the staged or delayed dispensing of laundry additive materials into a machine fabric laundering operation are disclosed in U.S. Pat. Nos. 4,026,131; 4,260,054; and 4,588,080; and in Canadian Patent 1,133,712. Arrangements involving a dispensing device and a pre-packaged amount of laundry additive material for staged or timed dispensing during a laundering operation are disclosed in U.S. Pat. Nos. 4,379,515 and 4,882,917 and in PCT Publications WO 01/07703 and WO 01/07702.

SUMMARY OF THE INVENTION

In its system aspects, the present invention is directed to a multiple chamber device which provides for the timed dispensing of laundry additive materials into a cycle of a multiple cycle operation which occur during the operation of a drum-containing automatic fabric laundering machine. Such an arrangement comprises a housing structure having at least two chambers positioned within the washing machine drum, a unit dose package which can be placed as an insert within the housing and which contains the additive materials to be dispensed into the washing machine drum, a piercing member for opening the insert to permit the release of its contents into the housing structure, a flow controller for moving additives from one chamber to a subsequent chamber, and selectively openable aperture for optionally releasing additives into the washing machine drum during the desired cycle.

The rigid housing structure is, positioned within the washing machine drum during the laundering operation. Typically the housing structure will be attached to the inner circumferential wall of the washing machine drum.

The unit dose insert package can be placed within the housing structure at the beginning of the laundering operation. This insert may be flexible or rigid and can comprise one or more separate compartments. At least one compartment of the insert contains the laundry additive material which is to be eventually added to the contents of the washing machine drum during the appropriate stage of the laundering cycle.

The system herein also comprises a puncturing element associated with either the housing structure or with the insert or with both to open the additive-containing compartment(s) of the unit dose insert. In the one embodiment, the opening of this compartment occurs when the insert is put into the dispenser and the lid is closed, wherein a piercing element such as a knife in the first chamber of the dispenser pierces a compartment of the insert and permits the emptying of the compartment contents into the housing structure during the first spin cycle. In addition to a knife or similar static puncturing element, the insert can be opened with a selectively actuated puncturing element of the type described in co-pending U.S. application Ser. No. 11/777,240 filed on even date herewith and entitled Universal Dispenser for Dispensing Laundry Additive During Automatic Machine Laundering of Fabrics (P&G Case No. 9505).

In one embodiment, the centrifugal force moves the additives from the insert into a first chamber of the dispenser via a tube provided in the piercing element after initiation of the spin cycle. The emptied contents are then held within the first chamber of the dispenser by the spin cycle centrifugal force and drain by gravitational force into the second chamber upon cessation of the spin cycle. In a manifestation of the embodiment, the second chamber comprises a selectively openable aperture (e.g., a valve or removable plug) which if open, releases the additives into the drum by gravitational force during the first rinse cycle. If the selectively openable aperture is closed, the contents remain in the second chamber until initiation of the next spin cycle, where the centrifugal force moves the contents from the second chamber to the third chamber and the contents are held within the third chamber of the dispenser by the centrifugal force until cessation of that spin cycle. The contents then drain through apertures in the third chamber by gravitational force into the wash drum.

In its method aspects, the present invention relates to the method of using the system described hereinbefore to bring about the appropriately timed dispensing of laundry additive materials into a selected wash or rinse cycle of the multiple stages of the laundering cycle during the operation of a drum-containing automatic washing machine for fabric laundering. Such a method comprises first positioning the housing structure hereinbefore described within the drum of the automatic washing machine in a location which will bring the housing into significant contact with water during the appropriate laundry cycle stage. Then, a unit dose package as hereinbefore described and containing laundry additive material to be dispensed is placed as an insert into the housing structure at the beginning of the laundering operation.

The automatic washing machine is then run through its operational cycle, including its spin cycle, to thereby move the contents from the insert into the first chamber of the housing structure by centrifugal force. Such contents are then held within the first chamber of the housing structure by the same ongoing spin cycle centrifugal force which moved the contents from the insert into the first chamber. Upon cessation of the spin cycle, the contents from the first chamber drain into the second chamber by gravitational flow where a selectively openable aperture may be opened to release the contents by gravitational flow from the second chamber of the housing structure into the water entering the washing machine drum. If the selectively openable aperture is closed, the contents move from the second chamber to the third chamber during the next spin cycle. Upon cessation of the spin cycle, the contents are released into the drum through apertures in the third chamber during the second rinse cycle.

In its device aspects, the present invention relates to a dispensing device which is an embodiment of the housing structure of the type hereinbefore described. It is this dispensing device which is to hold the unit dose package insert as hereinbefore described and bring about the timed addition of rinse additive materials from the insert into the washing machine drum during one of the rinse cycles.

The device is in the form of a housing structure which is usually rigid and suitable for holding an openable unit dose package containing the laundry additive material. The structure must also have an opening which is suitable for permitting insertion of the openable rinse additive unit dose package into the housing structure. In one embodiment, the housing structure contains a selectively openable aperture located in the housing structure in such a manner as to permit emptied or emptiable laundry additive contents of the opened insert to optionally pass by gravitational flow through such selective aperture means and into the rinse water present in the washing machine drum during the desired wash or rinse cycle. This gravitational flow occurs after cessation of the centrifugal force at the end of a spin cycle: If the aperture is closed, then the contents remain in the second chamber of the housing structure until initiation of the next spin cycle, wherein the contents move via centrifugal force into a third chamber and are held there until cessation of the spin cycle, wherein the contents drain into the wash drum through an aperture in the third chamber. In one embodiment, the housing structure will further contain a puncturing element, non-limiting examples of which include puncturing or rupturing knives, which will open the unit dose insert package placed therein, upon closing of the lid of the dispenser.

In its "kit" aspects, the present invention relates to combinations of items which can be provided or sold together in order to facilitate assembly and use of the laundry additive material dispensing systems and the practice of the methods of this invention. Thus such kits can include the combination of the unit dose insert package as hereinbefore described and the housing structure also as hereinbefore described. Such kits can also comprise the unit dose package inserts in combination with instructions on how to use such inserts with a pre-existing rigid housing structure in order to assemble the laundry additive dispensing systems herein or in order to carry out the methods-of-use herein.

DETAILED DESCRIPTION OF THE INVENTION

Figure 1:
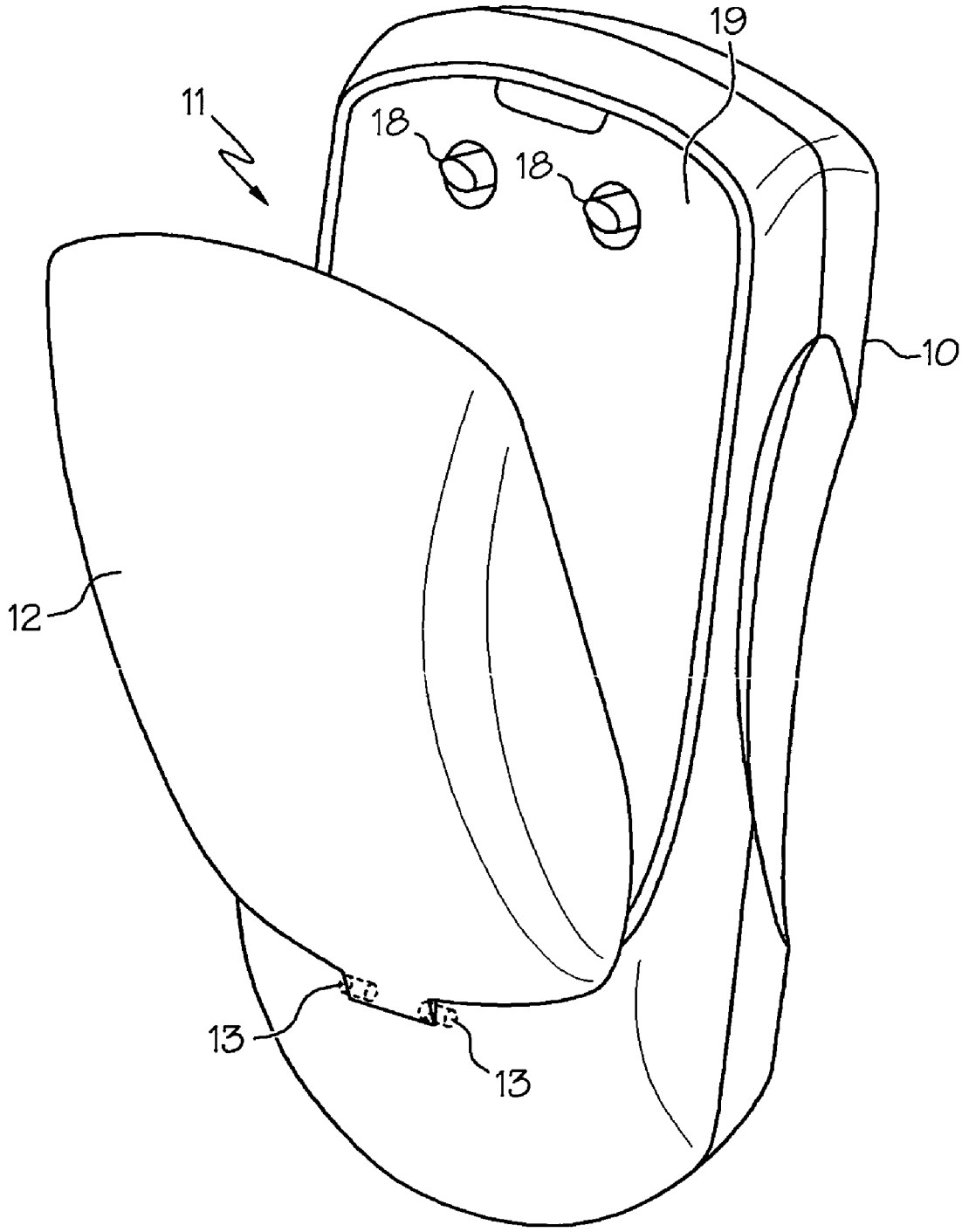
FIG. 1 is a perspective view of a housing structure in accordance with one embodiment of the invention.

FIG. 1 of the drawings shows a housing structure in accordance with one embodiment of the present invention. Such a housing structure (dispenser) comprises a base 10 having an opening 11 through which a unit dose rinse additive package (FIG. 5) can be inserted into the housing structure when the lid 12 is opened. The lid 12 is hinged at 13 to the base 10. The lid 12 can be opened as shown in FIG. 1 to permit insertion of the insert.

Figure 2:
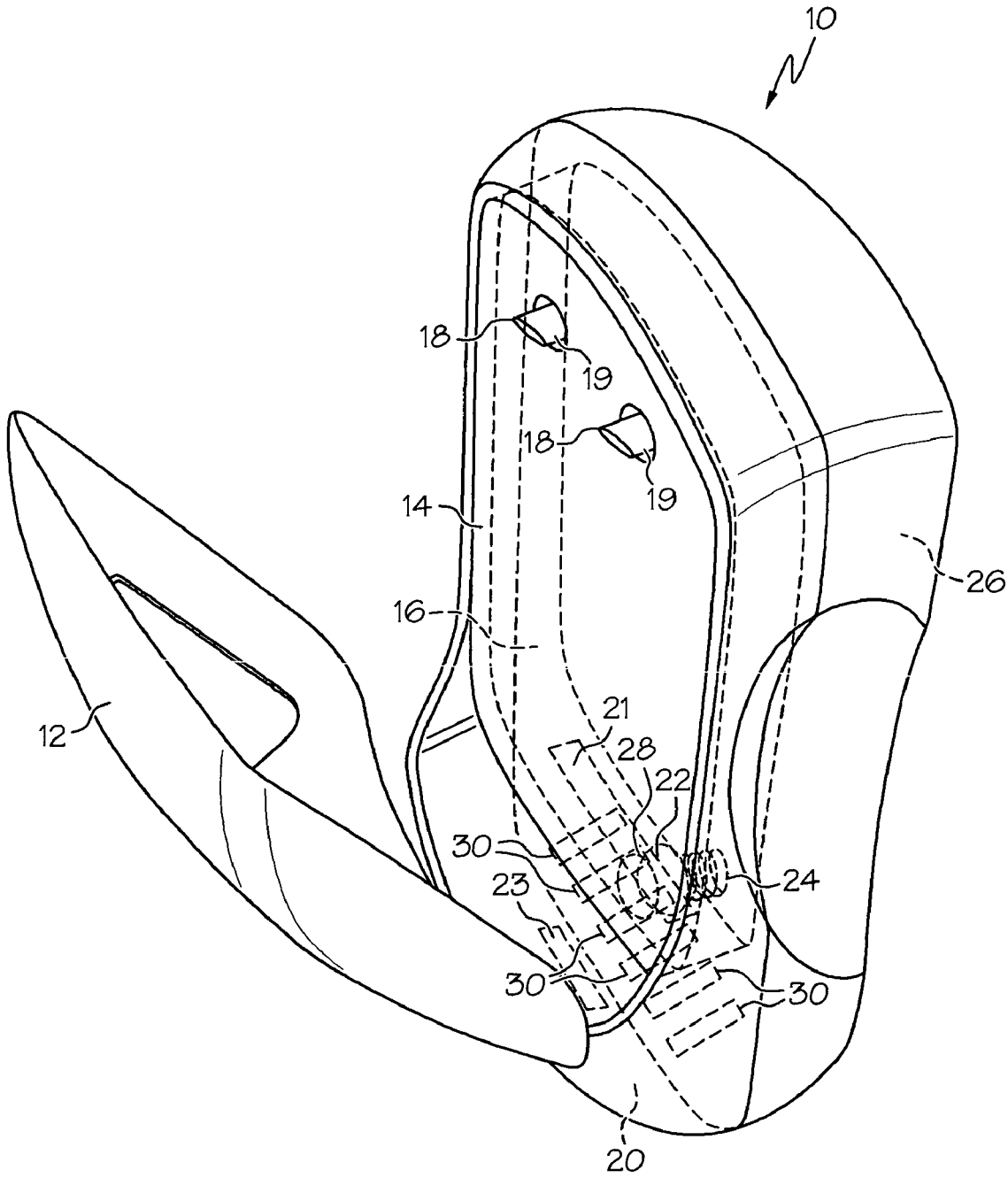
FIG. 2 is a side view of the housing structure of FIG. 1 with the lid open.

FIG. 2 shows a side view of a dispenser in one embodiment of the invention. The dispenser includes four chambers. Inner wall 14 stands between an outer chamber formed in the lid 12 and a first inner chamber 16. The wall 14 has a pair of piercing tubes 18 that pierce the insert upon closing of the lid 12. The tubes 18 also serve as conduits for the additives in the insert to enter the inner chamber 16 behind the wall 14 during the first spin cycle.

Figure 6:
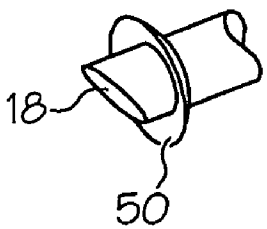
FIG. 6 is a partial view showing a sealing cup around a cutting tube in accordance with one embodiment of the invention.

The piercing tube 18 can be cut at an angle to provide a knife edge to cut the insert open. When the insert is put into the dispenser and the lid 12 is closed, the compartments of the insert are pierced by the tubes 18. To prevent the water from washing the additive out of the insert before the first spin cycle, the tubes 18 may include a small resilient cup 50 as shown in FIG. 6 that engages the insert and prevents water from entering the insert in substantial amounts. The tubes 18 are located so that when the insert compartment is initially pierced by the tubes 18, the laundry additives remain in the insert. During the first spin cycle, the centrifugal force generated by the spin causes the laundry additives to flow through the tubes 18 into the chamber 16 of the dispenser. As the laundry additives enter the chamber 16, the centrifugal force holds the additives in the chamber which has a back wall 17 until the spin cycle stops. When the spin cycle stops, the additives flow down through a rectangular opening 21 in the chamber 16 and into the lower portion 20 of the chamber 16. The lower portion of 20 of chamber 16 includes an inner back wall 29. Optionally, the lower portion 20 of chamber 16 may include in the bottom of the portion 20 a selectively openable aperture 23 that may be opened or closed by a removable plug (not shown). When the plug is removed, the additives will drain directly into the wash drum via the aperture after the first spin cycle. However, if the aperture is plugged, the additives remain in the lower chamber 20 until the initiation of the next spin cycle. In this way the dispenser can be used with additives that are released after a single spin cycle or the dispenser can be used with additives that are not to be released until after additional spin cycles.

Figure 3A:
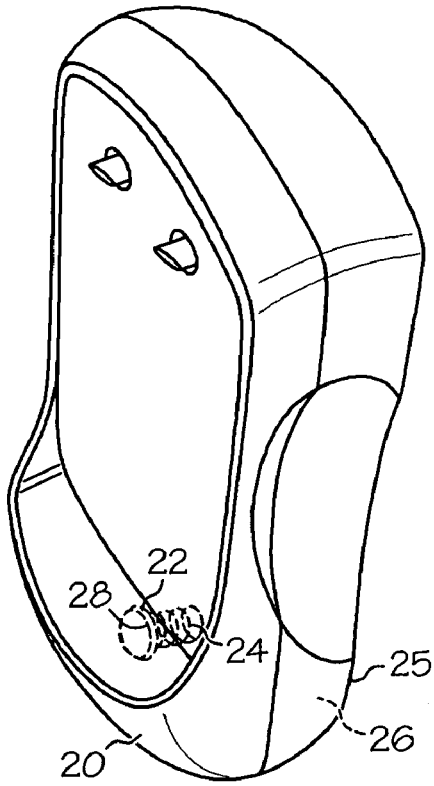
FIGS. 3A and 3B show a detailed view of a chamber having a centrifugally actuated valve.
Figure 3B:
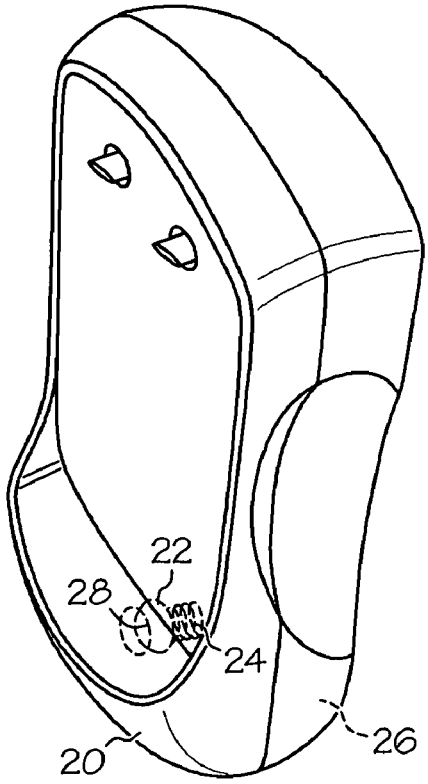
Figure 4:
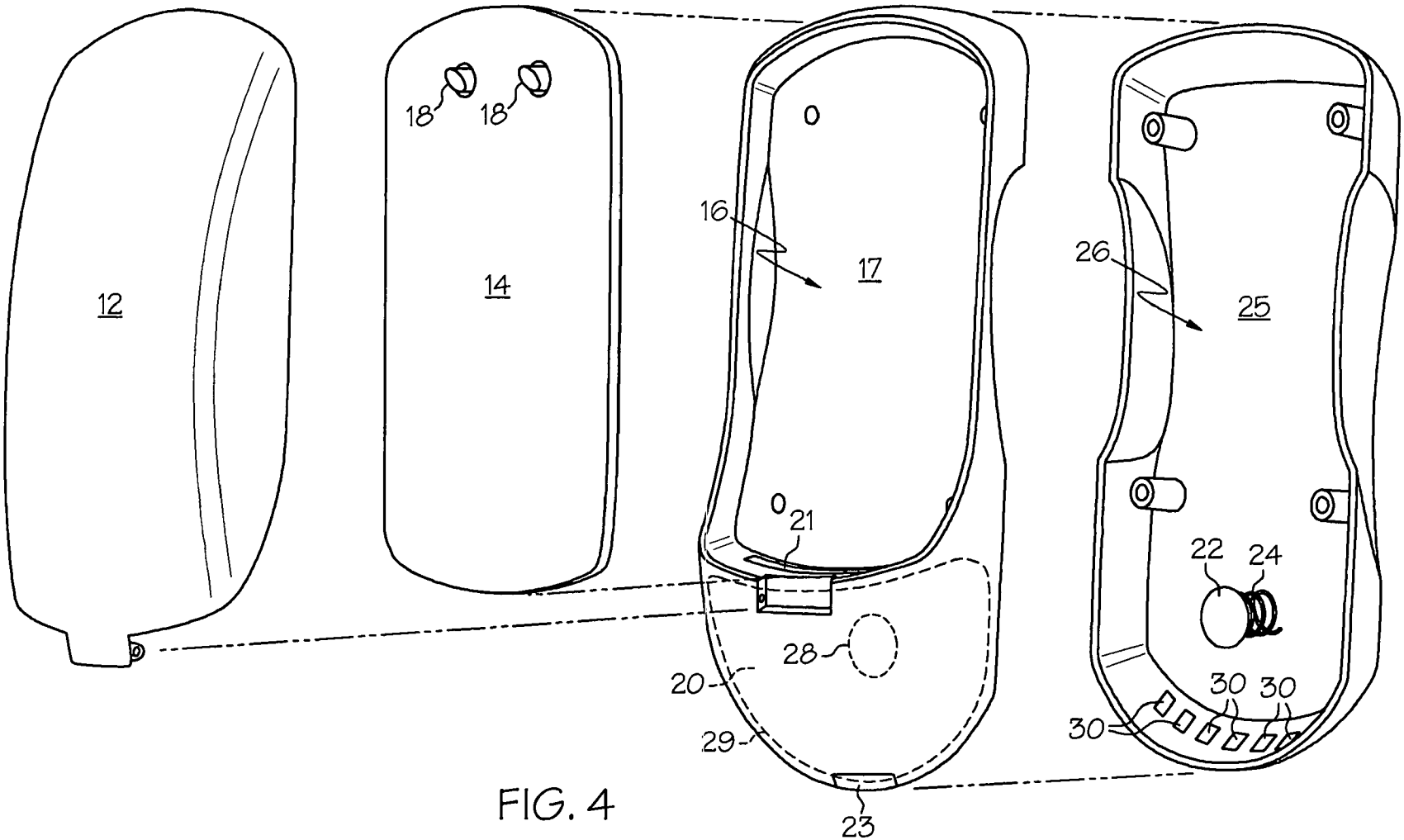
FIG. 4 of the drawings shows an exploded view of a housing in accordance with an embodiment of the invention.

The lower portion 20 of chamber 16 has a centrifugally actuatable valve 22 which seals an opening 28 in the inside back wall 21 of the second chamber 20. During the second spin cycle, centrifugal force opens the valve 22 and moves the additives into the third chamber 26. As shown in FIG. 3A, the centrifugally actuatable valve may be a knob 22 that is mounted on a spring 24 which is attached to the back wall 25 of the dispenser. As shown in FIG. 3A, when the knob 22 is in its original position and the washing machine is not spinning, the spring force on the knob 22 seals the opening 28 between the lower portion 20 and back chamber 26. However, during a spin cycle, the centrifugal force draws the knob towards the back chamber 26 compressing the spring 24, which opens the aperture 28 where upon the additives will flow from the lower portion 20 into the back chamber 26. In this way, the centrifugal force causes the additives to move from the lower portion 20 into the back chamber 26. As the additive moves into the back chamber 26, it is held in the back chamber 26 due to the centrifugal force. Once the spin cycle stops, the additive is then released through an array of apertures 30 in the base of the back chamber 26. Accordingly, the device may be used to selectively release the additives after either the first or the second spin cycle.

Although the multiple chamber dispenser depicted is used for a laundering operation having two rinse cycles, one skilled in the art will appreciate that more chambers may be added to the dispenser to allow the dispenser to be used in laundering operations having three or four or five etc. rinse cycles by incorporating various arrangements of additional chambers, selective aperture means, and centrifugally actuated valves.

Although the embodiment explained above is a dispenser having four internal chambers for use in a two-spin cycle operation, one skilled in the art can appreciate that a dispenser may have more chambers to accommodate laundering operations having more spin cycles. By incorporating selectively openable apertures and centrifugally actuated valves such as those described in the embodiment, a multiple chamber device may be used in laundering operations having three or four or five etc. spin cycles to deliver the additive to the desired laundry cycle.

Dispensing of laundry rinse additive materials in accordance with this invention takes place in a conventional automatic washing machine useful for the laundering of fabrics. Such automatic washing machines are those typically found in the home or in businesses such as self-service laundromats wherein individual consumers can launder their own loads of fabrics.

Automatic washing machines of the "North American" configuration typically utilize an upright or vertical drum or tub into which fabrics to be laundered are placed. Fabrics and laundry additives are added into the washing machine tub or drum, which is usually cylindrical, from the lidded top of the machine and are thus generally referred to as "top-loading" machines. Such North American style machines will frequently utilize a vertical agitator element placed along the axis of the drum. Rotation and vertical motion of the agitator serves to intensify the contact of fabrics in the drum with wash and rinse water in the drum. Japanese washing machines are typically similar in configuration to the North American machines.

Automatic washing machines of the "European" configuration commonly utilize a drum or tub, also generally cylindrical, which is positioned with the drum axis sideways or in a horizontal position. Fabrics and laundry additive materials are placed into the tub or drum of a washing machine of this configuration though a door on the front wall of the machine and are thus generally referred to as "front-loading" machines. Automatic washing machines of the European configuration typically do not utilize an agitator device or element.

Both North American and European automatic washing machines utilize a cycle of operation wherein the machine goes through a series of steps in which water is added, contacted with fabrics being laundered and then removed from the washing machine drum. Thus after fabrics are added to the drum, the first step in the laundering cycle is usually a washing step wherein significant amounts of water are added to the drum. The washing step involves a period wherein the fabrics being laundered are contacted with substantial amounts of water, generally with agitation or rotation of the drum. Water in the washing step will usually contain the primary laundry wash additives such as surfactants, builders, bleaches and/or enzymes which assist in and promote the removal of soil and stains from the fabrics being laundered.

At the conclusion of the washing step, water is removed from the washing machine drum. Frequently, this is brought about by gravity flow of wash water from the drum through appropriate valve configurations. Generally wash water is also removed by means of centrifugal force brought about by the drum rotating rapidly in a spin cycle. This centrifugal force moves water in the drum through holes or apertures in the circumferential walls of the drum. These holes lead to drainage means which can be opened and shut.

After the initial spin cycle, clean water is added back to the drum in a rinse cycle. Secondary laundry rinse additives such as fabric softeners or conditioners are generally contacted with the fabrics being laundered during the rinse cycle. Washing machine operation may also involve several additional spinning and rinsing cycles.

The present invention relates to the time specific dispensing of laundry rinse additive materials into the drum of an automatic washing machine as that machine is used for fabric laundering operations. For purposes of this invention, "laundry rinse additive materials" or simply "rinse additives" can comprise any solid or liquid materials which are conventionally added to the automatic washing machine drum during the rinse cycle of the fabric laundering procedure. Thus the list of suitable "laundry rinse additive materials" includes, but is not limited to, fabric softeners and conditioners, bleaches, enzymes, bleach and enzyme stabilizers, bleach and enzyme activators, aqueous and non-aqueous solvents, pH adjustment and control agents, dye transfer inhibitors, preservatives, anti-microbial agents, soil release agents, anti-wrinkle agents, chelating agents, optical brighteners, perfumes, pro-perfumes, dyes, and carriers.

Although there may be some overlap in the two classes of materials, "rinse additive materials" as used herein will generally be different and distinct from "laundry wash additive materials" or "wash additives" which may also be added to the laundering procedure, in addition to "rinse additive materials" in connection with some embodiments of the present invention. "Wash additive materials" will generally refer to any solid or liquid materials which are conventionally added to the automatic washing machine drum, along with fabrics being laundered, during the wash cycle of the laundering procedure. The wash cycle typically occurs at the beginning of the laundering operation. Most commonly wash additive materials can include, but are not limited to, primary cleaning agents such as detersive surfactants and detergent builders, chelating agents, anti-redeposition agents, dispersants, suds suppressors, suds boosters, and some of the same kinds of cleaning agents like bleaches and enzymes and adjuvants therefore which may also be used as rinse additives. A more detailed description of various laundry additive materials of both the rinse and wash variety can be found in WO 00/02982 and WO 00/02987.

The system, methods, devices and kits of the present invention are intended to provide timed dispensing of laundry rinse additive materials into the laundering process from a single unit dose package which contains such additives. Such rinse additive materials are dispensed into the washing machine as the machine proceeds through its operational spin and rinse cycles as hereinbefore described. This is accomplished using a rigid housing structure which is positioned within the machine and which holds and preferably opens a unit dose package containing the rinse additive materials to be dispensed. Ideally the unit dose used herein can be used to deliver from 10 to 50 grams, preferably from 15 to 35 grams, of laundry rinse additives to one or more "rinse" cycles of an automatic washing machine laundering operation.

The housing structure used in the instant invention must be positioned within the washing machine drum throughout the wash, spin and rinse cycles. Generally, the rigid housing structure will be positioned within the washing machine drum in a location such that it will be in contact with the rinse water in or being added to the drum during the rinse cycles of the laundering operation. One suitable non-limiting example of attachment means 61 is further described in U.S. application Ser. No. 10/737,429 filed Dec. 16, 2003.

Positioning of the rigid housing structure may be accomplished by attaching the housing to some specific point within the washing machine drum. Alternatively, the housing may be positioned by utilizing an unattached structure which is of such a shape or configuration that it suitably positions itself within the washing machine drum as a consequence of the forces it encounters during the laundering operation, or at least during the spin and rinse cycles.

Preferably, at the beginning of the laundering operation, the housing structure will be attached to some specific spot within the washing machine drum wherein it will stay during the entire laundering cycle. The housing structure may be positioned on or near the washing machine agitator (if there is one) or may be positioned on the floor (top loaders) or rear wall (front loaders) of the drum. Most preferably, however, the rigid housing structure will be affixed to the inner circumferential wall of the washing machine drum in a position so that at least at some point during the rinsing cycles it is in contact with water used in the cycle. For North American washing machines, this position will preferably be below the fill line for rinse water in the drum.

The housing structure may be of any suitable shape or configuration so long as it has an open inner volume within which the unit dose insert package can be placed and carried. The function and purpose of the rigid housing structure is to protect the integrity of the rinse additive unit dose package during the wash cycle(s) and to act as a receptacle for the contents of the unit dose package once that package has been opened during the spin cycle. Accordingly, the rigid housing structure will substantially surround the unit dose package once that package has been inserted into the housing. This may entail provision of an opening in the housing structure fitted with a lid which can be opened in order to permit insertion of the unit dose package and closed after the unit dose package has been inserted into the housing structure. Alternatively, the structure may comprise a base with a hinged cover that opens and closes to permit introduction of and subsequent protection for the unit dose insert. Since the function and purpose of the housing structure is to protect the unit dose package it carries during the wash cycle(s), the structure may be "rigid."

For purposes of this invention, a housing structure is considered "rigid" if it does not deform sufficiently to prematurely rupture or otherwise open the unit dose insert it carries as a consequence of forces or stresses which it encounters during the wash cycle(s). The rigid housing structure can be fashioned from any suitable solid material including plastic, metal, ceramic, wood, etc. so long as the structure maintains its configuration and mode of operation through the laundering cycle and in contact with the wash and rinse water used and with the laundry additive materials released from the opened unit dose insert. Preferably the rigid housing structure will be fashioned from thermoformed or injection molded plastic so that it can be readily and cost effectively mass-produced.

The housing structure serves to carry a unit dose package, placed therein at the beginning of the laundering operation, through to the spin and rinse cycles. This unit dose insert package will include at least one compartment containing rinse additive materials which are to be dispensed into the washing machine drum during a rinse cycle. The rigid housing structure must also be configured to deal with the contents of the unit dose insert package once that package has been opened within the housing.

Thus the rigid housing structure may be configured to permit water to readily enter the structure during the wash and rinse cycle of the laundering operation and to permit the contents of the opened insert to be dispensed from the structure into the washing machine drum. Most frequently this configuration will involve appropriately placed and positioned holes or apertures in the housing structure through which water from the laundering operation can enter and leave and through which additives from the opened insert can flow into the washing machine drum.

Finally, the rigid housing structure is preferably configured to hold substantially all (at least 90% by weight) of the rinse additive contents of the spin-cycle opened insert within the rigid housing until the spin cycle is completed. Thus the centrifugal force which moves the rinse additive contents of the unit dose insert into the inner chamber of the dispenser can also be used to hold the contents released from the opened compartment(s) within the structure, and even in some cases still within the opened compartment(s) of the insert, until the spin cycle is over. At the conclusion of the spin cycle, when the centrifugal force ceases, the contents of the opened inserts can then be allowed to flow from the first chamber to the second chamber by gravitational flow by selective aperture means into the wash drum. Alternatively, upon cessation of the spin cycle centrifugal force, the rinse additives may remain in the second chamber until the next spin cycle prior to the second rinse cycle by closing the selective aperture means where the additives move into the third chamber via centrifugal force to be released during the second rinse cycle.

Figure 5:
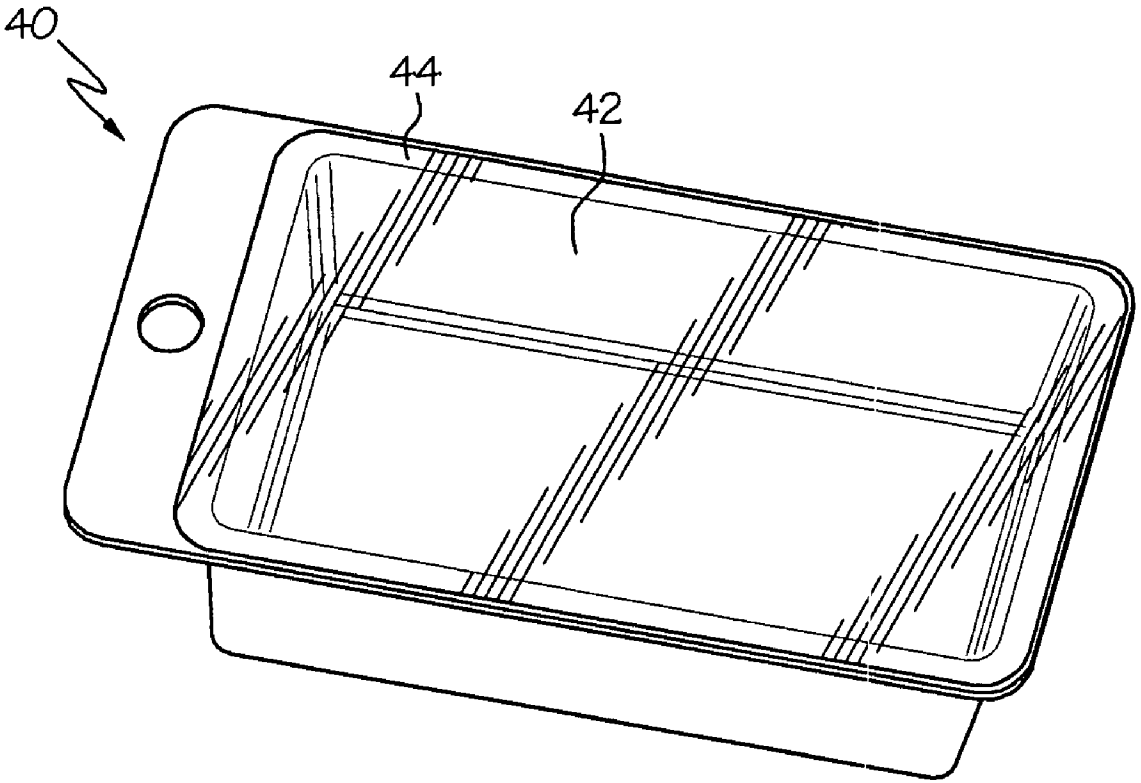
FIG. 5 is a perspective view of an insert useful in one embodiment of the invention.

The unit dose insert package itself must be sized and configured so as to work cooperatively with the housing structure into which it fits and within which it is used. The unit dose insert will thus comprise at least one compartment for laundry additive materials which are to be dispensed into the rinse cycle during the course of the laundering operation. Of course, the unit dose insert may utilize more than one compartment for additive materials. This may be useful when two additive materials are incompatible with each other and may be desirably separately packaged until they are added to the washing machine drum. The unit dose insert may also optionally contain separate compartments for laundry wash additive materials if the unit dose and housing structure are configured to dispense wash additives as well as rinse additives. One example of a unit dose insert is shown in FIG. 5 where the insert 40 includes a compartment 42 that is covered with a rupturable film 44.

A multi-compartmented insert may also be used in conjunction with the rigid housing structure to release additives at different times during the laundry cycle. For example, where a wash additive and a rinse additive are contained in separate compartments of the insert, the dispenser may be designed with piercing tubes 18 at different locations in the lidded chamber of the housing structure 10. For example, one of the tubes 18 may be positioned as shown in FIG. 1 and the other tube may be positioned near the bottom of the chamber such that when an insert having two compartments, one containing a wash cycle additive and another containing a rinse cycle additive, is placed in the rigid housing structure 10, the upper piercing tube pierces the rinse additive compartment and the proposed lower piercing tube pierces the wash additive compartment. By piercing the wash additive compartment with a lower piercing tube, the wash additive immediately drains from the compartment into the wash tub for use during the wash cycle. However, as explained above, the rinse cycle additive does not immediately drain from the rinse additive compartment in the insert and remains in the insert until the centrifugal force generated during the first spin cycle forces the rinse additive out of the insert through the piercing tube 18 and into the inner compartment 16. The rinse additive can be released immediately, in which case the aperture 23 is not plugged, or the release of the rinse additive can be postponed to a later point in the laundry cycle by plugging aperture 23 such that the additive is retained in the second chamber 20 until the subsequent spin cycle whereupon the rinse additive flows from the chamber 20 into the chamber 26 through the aperture 28 on the wall 21. After the second spin cycle, the rinse additive drains from compartment 26 into the wash tub through the openings 30.

As a further modification of the invention, the rinse additive compartment is not necessarily punctured when the lid is closed. Rather, the rigid housing structure can be modified to include a selectively actuatable puncturing element as described in the U.S. application mentioned above. As described in that application, the rigid housing structure can include a puncturing element which pivots from a position in which it does not rupture the insert to a position in which the insert is ruptured during a spin cycle. In one embodiment described in the aforementioned application, the rupturing element pivots to rupture the insert during the first spin cycle. In an alternative embodiment, the rupturing element includes a cam track which can be designed such that the insert is not ruptured until one or more subsequent spin cycles depending upon the design of the cam track.

Each compartment of the unit dose insert may be fashioned from water-insoluble materials, water-soluble materials or combinations of both types. Furthermore, some compartments of the insert may be made from water-insoluble materials while other compartments can be made from water-soluble materials. The compartments of the insert may also be flexible or rigid or have some compartments flexible and other compartments rigid.

If the unit dose insert, or compartment thereof, is to be rigid, it may be made from any conventional polymeric material which can be thermoformed or injection molded into a relatively rigid structure. Thus polyethylene, polypropylene, polystyrene or polyester (e.g., polyethylene terephthalate) are non-limiting examples of materials which may be used to form the unit dose insert. A polymer material should be chosen which has good heat stability, especially if the insert is to be utilized in European washing machines where water temperatures approach boiling. The material of the insert should also be inert to any chemicals which are present in the laundry additives which the insert is to deliver.

A preferred configuration for the unit dose insert comprises a thermoformed tub formed from water-insoluble plastic, such as for example, polypropylene or polyethylene. The tub can be sealed with a thin layer of puncturable or rupturable plastic or metal, e.g., aluminum, foil. In another preferred configuration, a pouch with the rinse additives may be flexible and fashioned from water-insoluble materials, e.g., polyethylene or polypropylene film. Either tub or pouch will, of course, contain sealed within the rinse additive materials to be dispensed from the opened insert package during the rinse stage of the laundering operation.

Either the rigid housing structure or the unit dose package insert to be placed within the housing or both must comprise some means to open the unit dose insert package at the appropriate point during the laundering cycle. Furthermore, these opening means must be activated by the centrifugal force which is applied to the unit dose insert during the spin cycle.

Most preferably, the rigid housing structure itself will comprise the means for opening an insert, preferably water-insoluble, held within it. Thus, for example, the means for opening the rinse additive-containing unit dose package may comprise sharp protrusions, blades or knives which will impinge on the unit dose insert upon closing of the lid.

Opening of the single or each of the several compartment(s) of the insert within the housing structure should permit most (at least 85% by weight), and preferably all, of the contents of the compartment so opened to be eventually combined with the wash or rinse water present in the washing machine drum during the rinse cycle. The water in the drum for any cycle during which an additive compartment is opened in the insert will typically eventually have added thereto from 5 to 50 grams, preferably from 15 to 35 grams, of additive material as a consequence of the opening of the additive compartment(s).

The rigid housing structure and the rinse additive insert packages therefor may be conveniently commercialized by marketing them in the form of kits. Thus the housing and insert which are to be used together in the systems and methods of this invention may be sold together, packaged as a unitary commercial kit product. Furthermore, the unit dose insert packages may be sold by themselves as refills for use in a rigid housing structure which the consumer may have previously purchased and has already installed on the washing machine to be used for practice of this invention. In the case of refills, the inserts can be marketed in combination with a set of instructions which describes the previously-purchased housing structure into which the unit dose fits and further describes the method of setting up and operating the housing/insert system in the consumer's automatic washing machine.

All documents cited are, in relevant part, incorporated herein by reference. The citation of any document is not to be construed as an admission that it is prior art with respect to the present invention. While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A system for providing laundry additive material to water during a cycle of a multiple cycle fabric laundering operation carried out in a drum-containing automatic washing machine, which system comprises:

a unit dose package containing a laundry additive material;

a housing structure into which said additive-containing unit dose package can be inserted, said housing structure being positioned within the drum of said automatic washing machine, said housing structure including a plurality of chambers; and a piercing element in said housing for opening said unit dose package;

wherein the chambers are interconnected and arranged such that during a first spin cycle, the additive flows from said unit dose package to a first chamber and, if the additive is not released from the housing after the first spin cycle, during a second spin cycle the additive flows from the first chamber to a subsequent chamber wherein the system additionally comprises a selectively openable aperture for providing gravitational flow of said additive from said housing structure into said washing machine drum when said aperture is open, and when said aperture is closed said additive moves to a subsequent chamber during said second spin cycle.

2. A system according to claim 1 wherein the system includes a centrifugally actuatable valve.

3. A system according to claim 2 wherein the centrifugally actuatable valve includes a knob attached to a spring, and wherein the knob seals an aperture in said housing and during a spin cycle said knob compresses said spring upon application of centrifugal force to open said aperture in said housing.

4. A system according to claim 1 wherein the piercing element includes a tube that is cut at an angle to provide a knife edge for opening the unit dose package.

5. A system according to claim 1 wherein the selectively openable aperture is in the base of the first chamber.

6. A system for providing laundry additive material to water during a cycle of a multiple cycle fabric laundering operation carried out in a drum-containing automatic washing machine, which system comprises:

a unit dose package containing a laundry additive material;

a housing structure into which said additive-containing unit dose package can be inserted, said housing structure being positioned within the drum of said automatic washing machine, said housing structure including a plurality of chambers; and a piercing element in said housing for opening said unit dose package;

wherein the chambers are interconnected and arranged such that during a first spin cycle, the additive flows from said unit dose package to a first chamber and, if the additive is not released from the housing after the first spin cycle, during a second spin cycle the additive flows from the first chamber to a subsequent chamber wherein said second chamber includes a selectively openable aperture at the base of said second chamber and wherein said unit dose package contains two compartments for additive materials whereby the additive drains immediately from one of the compartments when the package is opened.

7. A system according to claim 6 wherein a centrifugally actuatable valve is in an inside wall of said second chamber and said centrifugally actuatable valve controls the flow of said additive to a third chamber.

8. A system according to claim 7 wherein said third chamber comprises at least one opening at the base of said third chamber.

9. A method for introducing laundry additive material into water during a cycle which occurs in a multiple cycle fabric laundering operation carried out in a drum-containing automatic washing machine, which method comprises:

providing a unit dose package containing a laundry additive material;

providing a housing structure into which said additive-containing unit dose package can be inserted, said housing structure being positioned within the drum of said automatic washing machine, said housing structure comprising a plurality of chambers and a piercing element in said housing for opening said unit dose package, wherein the chambers are interconnected and arranged such that during a first spin cycle, the additive flows from said unit dose package to a first chamber and if said additive is not released from said housing after said first spin cycle, during a second spin cycle, said additive flows to a subsequent chamber;

running said automatic washing machine through one or more spin cycles to thereby apply centrifugal force to said additive-containing unit dose package within said housing structure, said centrifugal force serving to move the contents thereof into said first chamber of said housing structure and hold said contents within said first chamber during said first spin cycle, and thereafter said additive flows from said first chamber to a subsequent chamber during a second spin cycle.

10. A method according to claim 9 wherein said structure additionally comprises a selectively openable aperture for providing gravitational flow of said additive from said housing structure into said washing machine drum when said aperture is open, and wherein when said aperture is closed said additive moves sequentially to a subsequent chamber during a second spin cycle.

11. A method according to claim 9 wherein said structure includes a centrifugally actuatable valve.

12. A method according to claim 11 wherein said centrifugally actuatable valve includes a knob attached to a spring, and wherein said knob seals an aperture in said housing and during a spin cycle said knob compresses said spring upon application of centrifugal force to said aperture in said housing.

13. A method according to claim 9 wherein the piercing element includes a tube that is cut at an angle to provide a knife edge for opening the unit dose package.

14. A system according to claim 9 wherein said housing structure is attached to a specific location within said washing machine drum where it stays for the duration of the laundering operation.

15. A method according to claim 9 wherein said unit dose package contains one compartment for rinse additive material.

16. A method according to claim 9 wherein said unit dose package contains two compartments for rinse additive material.

17. A method according to claim 9 wherein said unit dose package is rigid and constructed from thermoformed polymeric material.

18. A method according to claim 9 wherein said unit dose package is constructed at least in part from flexible polymeric material.

19. A method according to claim 9 which delivers from about 5 to 50 grams of rinse additive material to one rinse cycle during said fabric laundering operation.

* * * * *